US007048615B2

(12) United States Patent
Chang et al.

(10) Patent No.: US 7,048,615 B2
(45) **Date of Patent: *May 23, 2006**

(54) PAD BACKER AND CMP PROCESS USING THE SAME

(75) Inventors: Li-Min Chang, Hsinchu (TW); Tong Liao, Hsinchu (TW); Chen-Wen Pao, Hsinchu (TW); Justin Huang, Hsinchu (TW)

(73) Assignee: United Microelectronics Corp., Hsinchu (TW)

( * ) Notice: Subject to any disclaimer, the term of this patent is extended or adjusted under 35 U.S.C. 154(b) by 5 days.

This patent is subject to a terminal disclaimer.

(21) Appl. No.: 10/908,781

(22) Filed: May 26, 2005

(65) Prior Publication Data

US 2006/0030241 A1 Feb. 9, 2006

Related U.S. Application Data

(63) Continuation-in-part of application No. 10/710,819, filed on Aug. 5, 2004.

(51) Int. Cl.
*B24B 29/00* (2006.01)

(52) U.S. Cl. ..... 451/41; 451/288; 451/490

(58) Field of Classification Search ..... 451/285, 451/286, 287, 288, 289, 41, 42, 490, 495
See application file for complete search history.

(56) References Cited

U.S. PATENT DOCUMENTS

| | | | | |
|---|---|---|---|---|
| 5,931,719 | A * | 8/1999 | Nagahara et al. | 451/41 |
| 6,095,900 | A * | 8/2000 | Fruitman et al. | 451/28 |
| 6,336,851 | B1 * | 1/2002 | Shendon | 451/303 |
| 6,390,891 | B1 * | 5/2002 | Guha et al. | 451/41 |
| 2003/0110609 | A1 * | 6/2003 | Taylor | 29/402.03 |
| 2003/0228836 | A1 * | 12/2003 | Lombardo et al. | 451/533 |
| 2004/0072502 | A1 * | 4/2004 | Taylor | 451/28 |

* cited by examiner

*Primary Examiner*—Jacob K. Ackun, Jr.
(74) *Attorney, Agent, or Firm*—Jiang Chyun IP Office

(57) ABSTRACT

A pad backer is described, comprising a backing plate, an elastomer layer and a pad backing ring. The elastomer layer has a bottom surface bonded to the backing plate and an upper surface with a protrudent part at the edge portion thereof. The pad backing ring has an inner bottom surface with a recessed part thereon matching with the protrudent part on the upper surface of the elastomer layer, such that the elastomer layer is fixed onto the pad backing ring through engagement of the protrudent part and the recessed part.

19 Claims, 3 Drawing Sheets

PAD BACKER AND CMP PROCESS USING THE SAME

CROSS-REFERENCE TO RELATED APPLICATION

This application is a continuation-in-part of a prior application Ser. No. 10/710,819, filed Aug. 15, 2004.

BACKGROUND OF THE INVENTION

1. Field of the Invention

The present invention relates to a tool used in semiconductor processes. More particularly, the present invention relates to a structure of a pad backer used in a chemical mechanical polishing (CMP) process, and to a CMP process using the pad backer. The pad backer has a longer lifetime and is capable of not damaging the surface of the polished object when broken in use in a CMP process.

2. Description of Related Art

CMP is the most important technique for globally planarizing a substrate surface. In a typical CMP process, the substrate to be polished is pressed onto a polishing pad to which polishing slurry is supplied, while the polishing pad is placed on a rotated polishing stage of the CMP machine. The polishing pad is usually placed on a flat pad backer that is mounted on the polishing stage and rotated together with the polishing stage.

FIGS. 1A and 1B illustrate a conventional pad backer in an exploded perspective view and in a cross-sectional view, respectively, the pad backer being usually used in a tungsten (W) CMP process. The pad backer 100 includes a thin stainless steel plate 110, a polyurethane (PU) layer 120 and a pad backing ring 130, wherein the PU layer 120 is fixed onto the stainless steel plate 110 via a back adhesive 140 and rivets 150. The PU layer 120 carries a polishing pad 10 in a CMP process, and the pad backing ring 130 is for keeping the stainless steel plate 110 on the polishing stage. The PU layer 120 is smaller than the stainless steel plate 110, so that a gap 160 is formed between the PU layer 120 and the pad backing ring 130. During a CMP process, the stainless steel plate 110, the PU layer 120 and the polishing pad 10 together are slightly swollen upward by a gas blast from below, so that the substrate can well contact with the polishing pad.

As mentioned above, the polishing pad 10 and the underlying PU layer 120 are pressed by a substrate and rotated relative to the substrate in a CMP process. Therefore, a shear stress is generated between the PU layer 120 and the stainless steel plate 110. Meanwhile, the polishing slurry that usually contains corrosive components inevitably flows through the gap 160 and contacts with the back adhesive 140 between the PU layer 120 and the stainless steel plate 110 to degrade it. Therefore, the PU layer 120 will be delaminated from the stainless steel plate 110 usually after the pad backer 100 is used for polishing 1500 pieces of wafers. Once the delamination occurs in a CMP process, the rivets 150 are pulled away because of the shear stress caused by the polishing operation, and the wafer being polished will be damaged severely by the rivets 150.

SUMMARY OF THE INVENTION

In view of the foregoing, this invention is directed to a durable pad backer that is capable of not damaging the surface of the polished object when broken in use.

This invention is also directed to a CMP process that uses the same pad backer.

The pad backer of this invention includes a backing plate, an elastomer layer and a pad backing ring. The elastomer layer has a bottom surface bonded to the backing plate, and the pad backing ring has an inner portion engaged with the edge portion of the upper surface of the elastomer layer for fixing the elastomer layer onto the pad backing ring.

In an embodiment of this invention, the upper surface of the elastomer layer has at least one protrudent part or recessed part at the edge portion thereof, and the inner portion of the pad backing ring has a bottom surface with at least one recessed part or protrudent part thereon matching with the protrudent part or the recessed part on the elastomer layer. The elastomer layer is fixed onto the pad backing ring through engagement of the protrudent part and the recessed part.

In the CMP process of this invention, a pad backer as mentioned above is fixed onto a rotatable platen, and a polishing pad is placed on the pad backer. Thereafter, a substrate formed with a material layer to be polished thereon is pressed onto the polishing pad. The rotatable platen is rotated and simultaneously a polishing slurry is supplied between the substrate and the polishing pad, so as to polish the material layer.

In the above pad backer, the elastomer layer may have the same size of the backing plate, so that the bonding area between the elastomer layer and the backing plate is larger than before. Therefore, the shear stress per unit area of adhesive is reduced. Meanwhile, the engagement of the protrudent part and the recessed part matching with each other prevents access of the polishing slurry to the adhesive, so that the adhesive is not corroded by the polishing slurry. Consequently, the adhesive is deteriorated more slowly, thereby increasing the lifetime or the durability of the pad backer. Moreover, since the elastomer layer is fixed onto the pad backing ring, the use of rivets could be avoided in the pad backer of this invention. Therefore, when the pad backer is broken in use in a CMP process, the surface of the object being polished will not be damaged by the pad backer in absence of rivets.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The following drawings illustrate embodiments of the invention and, together with the description, serve to explain the principles of the invention.

FIGS. 3A and 3B illustrate a CMP process setting according to the embodiment of this invention, wherein FIG. 3A shows the arrangement of the pad backer in the CMP system and FIG. 3B shows a local view of an example of the polished substrate.

DESCRIPTION OF THE EMBODIMENTS

Figure 2A:
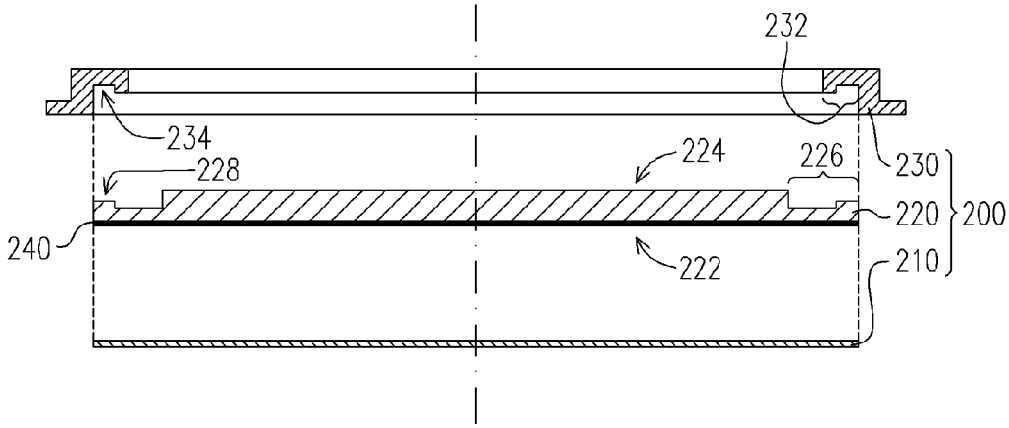
FIGS. 2A and 2B illustrate a pad backer according to an embodiment of this invention in an exploded cross-sectional view and in a cross-sectional view, respectively.
Figure 2B:
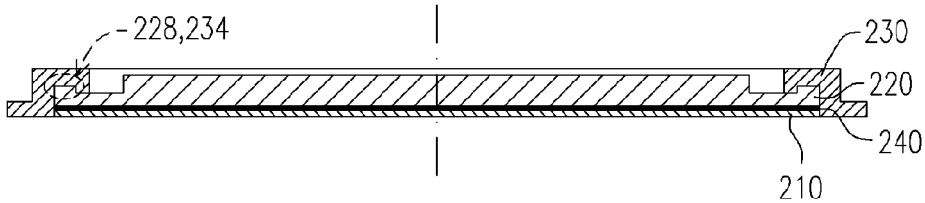

FIGS. 2A and 2B illustrate a pad backer according to an embodiment of this invention in an exploded cross-sectional view and in a cross-sectional view, respectively.

Referring to FIGS. 2A and 2B, the pad backer 200 according to an embodiment of this invention includes a backing plate 210, an elastomer layer 220 and a pad backing ring 230. The material of the backing plate 210 is, for example, stainless steel or other anti-corrosion material having high rigidity, while the backing plate 210 is sufficiently thin so that it can be swollen upward by a gas blast from below.

Figure 1A:
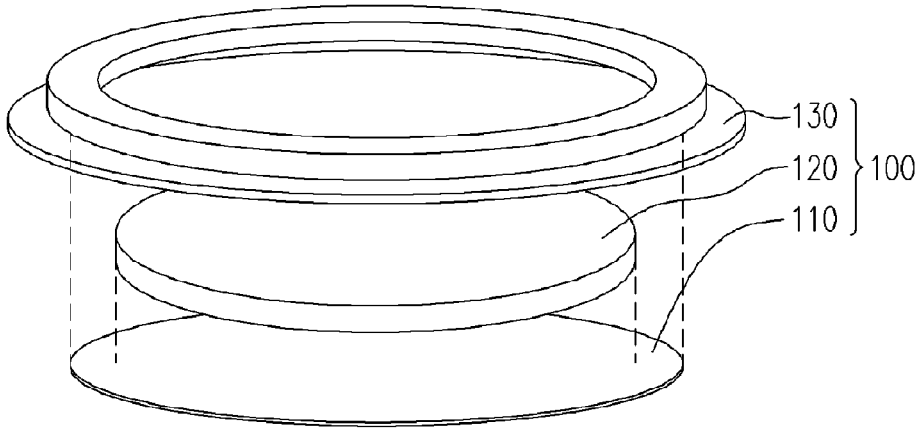
FIG. 1A (PRIOR ART)
FIGS. 1A and 1B illustrate a conventional pad backer in an exploded perspective view and in a cross-sectional view, respectively.
Figure 1B:
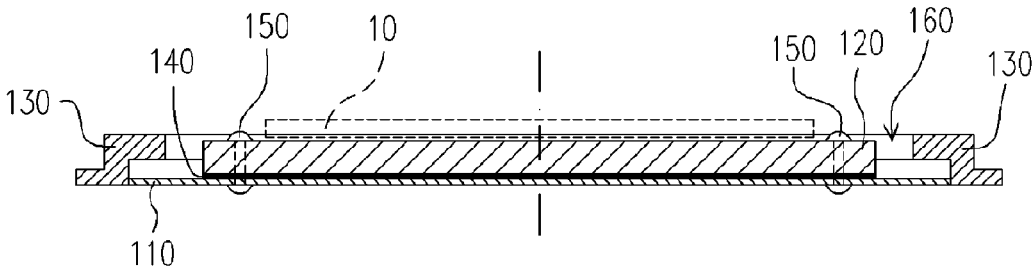
FIG. 1B (PRIOR ART)

The elastomer layer 220 has a bottom surface 222 bonded to the backing plate 210 with an adhesive 240, and the edge portion 226 of the upper surface 224 of the elastomer layer 220 has a protrudent part 228 thereon. The elastomer layer 220 is larger than the elastomer layer 120 in the conventional pad backer 100 (FIG. 1B) and may even have the same size of the backing plate 210, while the additional part of the elastomer layer 220 is for forming the protrudent part 228. The material of the elastomer layer 220 is, for example, polyurethane (PU) or other anti-corrosion elastomer, and the elastomer layer 220 with a protrudent part 228 can be molded as a whole using a die having a cavity of the corresponding shape.

The pad backing ring 230 has an inner portion with a bottom surface 232, on which a recessed part 234 is formed. The recessed portion 234 matches with the protrudent part 228 at the edge portion 226 of the elastomer layer 220, so that the elastomer layer 220 can be fixed onto the pad backing ring 230 through engagement of the recessed part 234 and the protrudent part 228. The material of the pad backing ring 230 is, for example, stainless steel or other anti-corrosion material.

Though the recessed part is formed on the pad backing ring and the protrudent part on the elastomer layer in the above embodiment of this invention, the recessed part and the protrudent part may be alternatively formed on the elastomer layer and the pad backing ring, respectively. Furthermore, there can be more than one such pair of recessed part and protrudent part formed on the elastomer layer and the pad backing ring, and each of the elastomer layer and the pad backing ring may simultaneously have at least one recessed part and at least one protrudent part. In addition, the shapes of the protrudent part and/or the recessed part may also be modified to reinforce the bond between the elastomer layer and the pad backing ring.

Figure 3A:
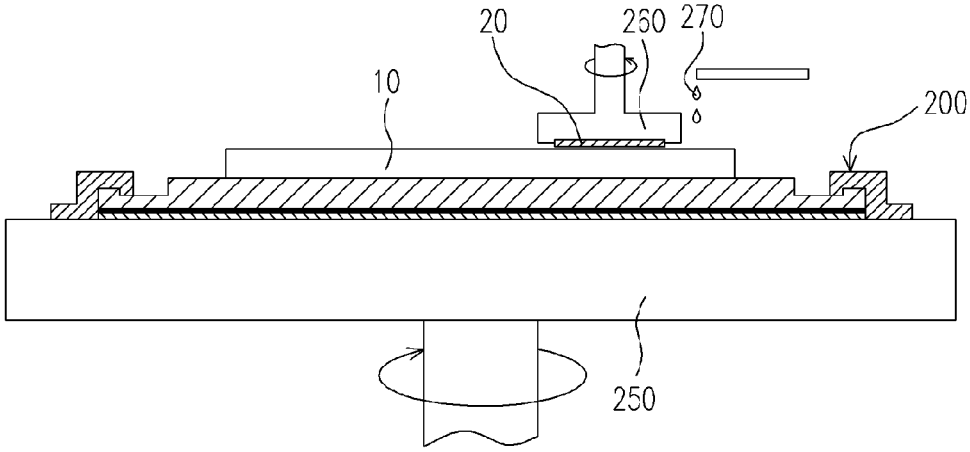
Figure 3B:
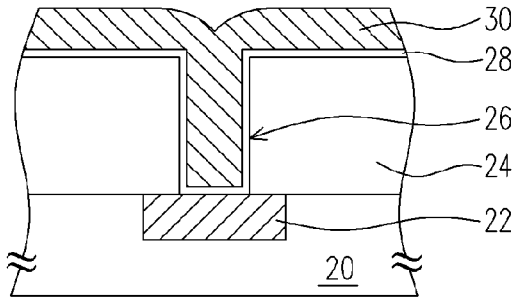

FIGS. 3A and 3B illustrate a CMP process setting according to the embodiment of this invention, wherein FIG. 3A shows the arrangement of the pad backer in the CMP system and FIG. 3B shows a local view of an example of the polished substrate.

Referring to FIG. 3A, in the CMP process, the pad backer 200 is fixed onto a rotatable platen 250, and a polishing pad 10 is placed on the pad backer 200. Then, a rotatable holder 260 is used to hold a substrate 20, such as a semiconductor (e.g. silicon) wafer, formed with a material layer to be polished thereon to press the substrate 20 onto the polishing pad 10. The material layer is a conductive layer or a dielectric layer, for example, wherein the conductive layer is preferred. The rotatable platen 250 and the rotatable holder 260 are then rotated and simultaneously a polishing slurry 270 is supplied between the substrate 20 and the polishing pad 10, so as to polish the material layer.

Referring to FIG. 3B, when the material layer to be polished is a conductive layer (30) like a tungsten layer, the conductive layer 30 may be, for example, one for forming a damascene structure in an opening 26 in a dielectric layer 24 formed on the substrate 20. The damascene structure can be a conductive plug, a conductive line or a dual damascene structure including a plug and a line, and will be formed after the conductive layer 30 outside the opening 26 is removed through CMP. The substrate 20 has a conductive layer 22 to be electrically connected therein, while a barrier layer 28, such as a Ti/TiN or TiN layer, is preferably formed prior to the conductive layer 30 when the latter includes tungsten, copper or the like. In addition, the polishing slurry for polishing a tungsten layer may contain silica particles, KOH and water, for example.

Since the bonding area between the elastomer layer and the backing plate in the pad backer of this invention is larger than before, the shear stress per unit area of adhesive is reduced. Meanwhile, since the engagement of the protrudent part and the recessed part matching to each other prevents access of the polishing slurry to the adhesive, the adhesive is not corroded by the polishing slurry. Consequently, the adhesive is deteriorated more slowly, thereby increasing the lifetime or the durability of the pad backer. Moreover, since the elastomer layer is fixed onto the pad backing ring, the use of rivets could be avoided in the pad backer according to the present embodiment of this invention. Therefore, when the pad backer is broken in use in a CMP process, the surface of the object being polished will not be damaged by the pad backer of this invention in absence of rivets.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A chemical mechanical polishing (CMP) process, comprising:

fixing a pad backer onto a rotatable platen, wherein the pad backer comprises:

a backing plate;

an elastomer layer, having a bottom surface bonded to the backing plate and an upper surface with at least one protrudent part or recessed part at an edge portion thereof; and a pad backing ring, having an inner bottom surface with at least one recessed part or protrudent part thereon matching with the protrudent part or the recessed part on the upper surface of the elastomer layer, such that the elastomer layer is fixed onto the pad backing ring through engagement of the protrudent part and the recessed part;

placing a polishing pad on the pad backer;

pressing a substrate formed with a material layer to be polished thereon onto the polishing pad; and rotating the rotatable platen and simultaneously supplying a polishing slurry between the polishing pad and the substrate, so as to polish the material layer.

2. The CMP process of claim 1, wherein the material layer comprises a tungsten layer.

3. The CMP process of claim 2, wherein the tungsten layer is formed for fabricating a damascene structure.

4. The CMP process of claim 2, wherein in the pad backer, the recessed part is on the inner bottom surface of the pad backing ring and the protrudent part on the edge portion of the upper surface of the elastomer layer.

5. The CMP process of claim 2, wherein in the pad backer, the backing plate and the elastomer layer has the same lateral area.

6. The CMP process of claim 2, wherein in the pad backer, the elastomer layer is bonded to the backing plate via an adhesive.

7. The CMP process of claim 2, wherein in the pad backer, the backing plate comprises stainless steel.

8. The CMP process of claim 2, wherein in the pad backer, the elastomer layer comprises polyurethane (PU).

9. The CMP process of claim 2, wherein in the pad backer, the pad backing ring comprises stainless steel.

10. The CMP process of claim 2, wherein the polishing slurry comprises silica particles, KOH and water.

11. A chemical mechanical polishing (CMP) process, comprising:

fixing a pad backer onto a rotatable platen, wherein the pad backer comprises:

a backing plate;

an elastomer layer, having a bottom surface bonded to the backing plate; and a pad backing ring, having an inner portion engaged with an edge portion of an upper surface of the elastomer layer for fixing the elastomer layer onto the pad backing ring;

placing a polishing pad on the pad backer;

pressing a substrate formed with a material layer to be polished thereon onto the polishing pad; and rotating the rotatable platen and simultaneously supplying a polishing slurry between the polishing pad and the substrate, so as to polish the material layer.

12. The CMP process of claim 11, wherein the material layer comprises a tungsten layer.

13. The CMP process of claim 12, wherein the tungsten layer is formed for fabricating a damascene structure.

14. The CMP process of claim 12, wherein in the pad backer, the backing plate and the elastomer layer has the same lateral area.

15. The CMP process of claim 12, wherein in the pad backer, the elastomer layer is bonded to the backing plate via an adhesive.

16. The CMP process of claim 12, wherein in the pad backer, the backing plate comprises stainless steel.

17. The CMP process of claim 12, wherein in the pad backer, the elastomer layer comprises polyurethane (PU).

18. The CMP process of claim 12, wherein in the pad backer, the pad backing ring comprises stainless steel.

19. The CMP process of claim 12, wherein the polishing slurry comprises silica particles, KOH and water.

* * * * *